US009195201B2

(12) United States Patent
Shimada et al.

(10) Patent No.: US 9,195,201 B2
(45) Date of Patent: Nov. 24, 2015

(54) GLOSS APPLICATOR AND IMAGE FORMING APPARATUS INCLUDING THE GLOSS APPLICATOR

(71) Applicants: Hiroyuki Shimada, Kanagawa (JP); Akiyasu Amita, Kanagawa (JP)

(72) Inventors: Hiroyuki Shimada, Kanagawa (JP); Akiyasu Amita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/488,391

(22) Filed: Sep. 17, 2014

(65) Prior Publication Data

US 2015/0086255 A1 Mar. 26, 2015

(30) Foreign Application Priority Data

Sep. 26, 2013 (JP) ..... 2013-199948

(51) Int. Cl.
*G03G 15/20* (2006.01)
*G03G 15/00* (2006.01)

(52) U.S. Cl.
CPC ..... *G03G 15/6585* (2013.01)

(58) Field of Classification Search
USPC ..... 399/341
See application file for complete search history.

(56) References Cited

U.S. PATENT DOCUMENTS

| | | | | |
|---|---|---|---|---|
| 7,783,242 | B2 * | 8/2010 | Chigono et al. | 399/341 |
| 8,331,839 | B2 * | 12/2012 | Kunii et al. | 399/323 |
| 2011/0188911 | A1 | 8/2011 | Kunii et al. | |
| 2012/0201579 | A1 | 8/2012 | Kunii et al. | |
| 2012/0224898 | A1 | 9/2012 | Amita et al. | |
| 2012/0328343 | A1 | 12/2012 | Kunii et al. | |
| 2012/0328344 | A1 | 12/2012 | Kunii et al. | |
| 2012/0328345 | A1 | 12/2012 | Kunii et al. | |
| 2012/0328346 | A1 | 12/2012 | Amita et al. | |
| 2013/0004220 | A1 | 1/2013 | Muramatsu et al. | |
| 2013/0149017 | A1 | 6/2013 | Amita et al. | |
| 2013/0170882 | A1 | 7/2013 | Shimada et al. | |
| 2014/0016975 | A1 | 1/2014 | Shimada et al. | |

FOREIGN PATENT DOCUMENTS

| | | |
|---|---|---|
| JP | 5-333643 | 12/1993 |
| JP | 2004-198844 | 7/2004 |
| JP | 2004-325934 | 11/2004 |
| JP | 2005-148138 | 6/2005 |
| JP | 2009-014876 | 1/2009 |
| JP | 2010-187324 | 8/2010 |
| JP | 2012-254621 | 12/2012 |
| JP | 2013-003518 | 1/2013 |

* cited by examiner

*Primary Examiner* — Clayton E Laballe
*Assistant Examiner* — Warren K Fenwick
(74) *Attorney, Agent, or Firm* — Oblon, McClelland, Maier & Neustadt, L.L.P.

(57) ABSTRACT

A gloss applicator includes a belt to feed a recording material, including a substrate and a surface layer contacting a surface of the recording material an image is formed on; a heater to heat the belt; and a cooler to cool the belt. The surface layer is not an elastomer, the recording material is fed while the belt contacts the surface thereof, the belt heated by the heater heats the recording material, the belt cooled by the cooler cools the recording material, and the recording material is released from the belt.

9 Claims, 7 Drawing Sheets

GLOSS APPLICATOR AND IMAGE FORMING APPARATUS INCLUDING THE GLOSS APPLICATOR

CROSS-REFERENCE TO RELATED APPLICATIONS

This patent application is based on and claims priority pursuant to 35 U.S.C. §119 to Japanese Patent Application No. 2013-199948, filed on Sep. 26, 2013, in the Japan Patent Office, the entire disclosure of which is hereby incorporated by reference herein.

BACKGROUND

1. Technical Field

The present invention relates to a gloss applicator applying gloss to an image formed on a recording medium, and an image forming apparatus including the gloss applicator.

2. Description of the Related Art

Gloss applicators to apply gloss to images formed by image forming apparatuses such as copiers, facsimiles and printers, which are located in or outside of the image forming apparatuses are known.

Each of Japanese published unexamined patent applications Nos. JP-2009-14876-A, JP-2004-325934-A, JP-H05-333643-A, JP-2013-3518-A, JP-2004-198844-A and JP-2005-148438-A discloses a gloss applicator including a belt feeding a recording material, a heater heating the belt, and a cooler cooling the belt, which heats and cools the recording material to transfer the surface status of the belt the recording material to apply gloss to an image on the recording material Each of the above Japanese published unexamined patent applications discloses the belt includes a substrate and an elastic layer formed of a rubber overlying the substrate.

Japanese published unexamined patent application No. JP-2013-3518-A discloses a method of suctioning the belt and improves contactness between the recording material being fed and the belt to prevent or decrease wrinkles and waves of the belt while feeding the recording material. Japanese published unexamined patent application No. JP-2004-198844-A discloses a method of keeping a linear expansion coefficient of the substrate not greater than 1 ppm/° C. to prevent or decrease wrinkles and waves of the belt while feeding the recording material. Each of Japanese published unexamined patent applications Nos. JP-2010-187324-A and JP-2012-254621-A discloses a film material having a linear expansion coefficient not greater than 5 ppm/° C.

However, a belt having an elastic layer does not fully transfer a pressure to the surface of a recording material when overlapped thereon to apply the pressure thereto due to elastic deformation.

A belt without an elastic layer has poor releasability from a recording material.

SUMMARY

Accordingly, a need exist for a gloss applicator applying gloss to a recording material, which has high transferability of the surface status of a belt to the recording material and high releasability of the belt therefrom.

Another object of the present invention is to provide an image forming apparatus including the gloss applicator These objects and other objects of the present invention, either individually or collectively, have been satisfied by the discovery of a gloss applicator, including a belt to feed a recording material including a substrate and a surface layer contacting a surface of the recording material an image is formed on; a heater to heat the belt; and a cooler to cool the belt, wherein the surface layer is not an elastomer, the recording material is fed while the belt contacts the surface thereof, the belt heated by the heater heats the recording material, the belt cooled by the cooler cools the recording material, and the recording material is released from the belt.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
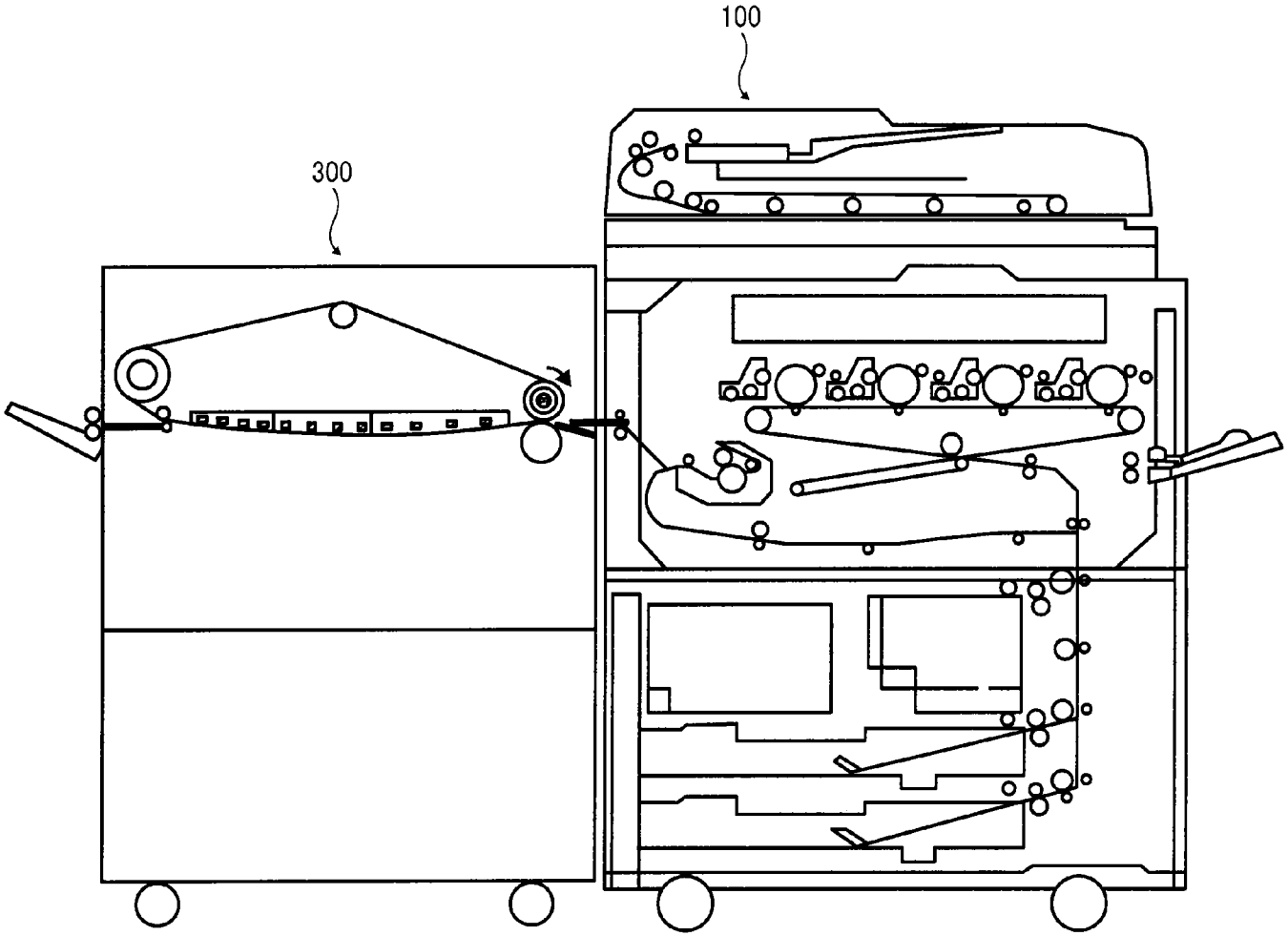
FIG. 1 is a schematic view illustrating an embodiment of the image forming apparatus and the gloss applicator of the present invention.

The present invention provides a gloss applicator applying gloss to a recording material, which has high transferability of the surface status of a belt to the recording material and high releasability of the belt therefrom.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The gloss applicator of the present invention is connected with an image forming apparatus 100 as shown in FIG. 1. The gloss applicator 300 and the image forming apparatus 100 transmit and receive information to and from each other.

Hardware Configuration of Image Forming Apparatus

The image forming apparatus 100 forms an image on a paper P which is an example of recording materials by duplicating or printing with a toner as a recording agent.

Figure 2:
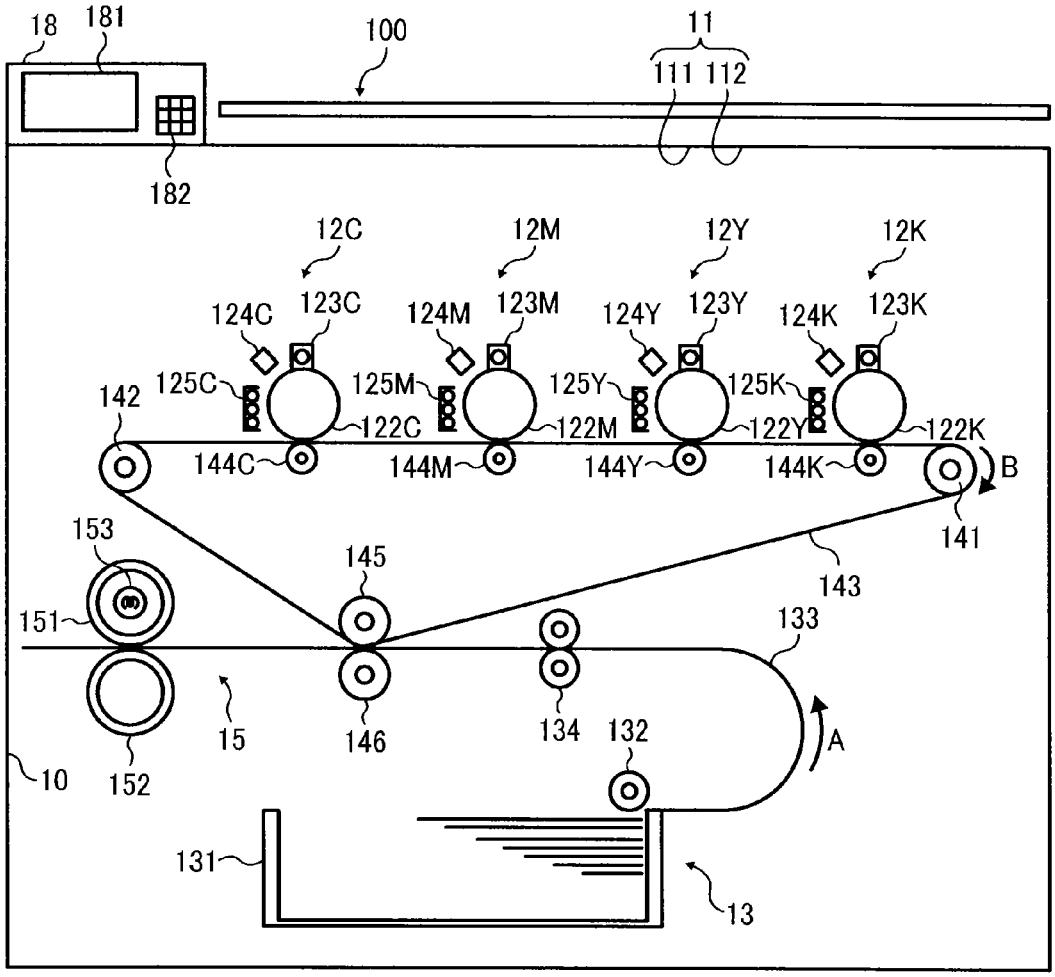
FIG. 2 is a schematic view illustrating an embodiment of the image forming apparatus of the present invention.

A scanner 11 is located on the top of the image forming apparatus 100 as FIG. 2 shows. The scanner 11 optically reads an original placed on a contact glass 11 to produce an RGB image information. Specifically, the scanner 11 emits light to the paper P and receives reflection light with a reading sensor 112 such as CCD (charge coupled devices) or CIS (contact image sensor) to read the RGB image information. The RGB image information represents an image formed on the paper P and includes brightness of colors of red (R), green (G) and blue (B).

The image forming apparatus 100 further includes a drive roller 141, a driven roller 142, a second transfer roller 145 and an intermediate transfer belt 143 hung over the rolls. Four photoreceptor drums 122C, 122M, 122Y and 122K are located so as to contact the intermediate transfer belt 143. A cyan (C) colored toner, a magenta (M) colored toner, a yellow colored toner (Y) and a black (K) colored toner form an image. Each of images formed on each of the photoreceptor drums is transferred on the same part of the intermediate transfer belt 143 to forma colored toner image on the surface of the intermediate transfer belt 143.

The image forming apparatus 100 further includes a second transfer counter-roller 146 opposite to the second transfer roller 145. The intermediate transfer belt 143 is put between second transfer roller 145 and the second transfer counter-roller 146 applied with a second transfer bias to (second) transfer a toner image formed on the surface of the intermediate transfer belt 143 onto the paper P. The second transfer bias is a charge reverse to the charge of the surface of the intermediate transfer belt 143.

The image forming apparatus 100 further includes a charger 123C near the photoreceptor drum 122C. The charger 123C uniformly charges the surface of the photoreceptor drum 122C. An irradiator 124C is also located near the photoreceptor drum 122C. The irradiator 124C forms an electrostatic latent image on the charged surface of the photoreceptor drum 122C, based on a C-colored toner adherence amount determined by a controller mentioned later. Further, an image developer 125C is located near the photoreceptor drum 122C, which transfers a toner onto the electrostatic latent image formed on the photoreceptor drum 122C to form a toner image on the surface thereof.

The image forming apparatus 100 further includes a first transfer roller 144C opposite to the photoreceptor drum 122C. The first transfer roller 144C applies a first transfer bias to transfer the toner image on the surface of the photoreceptor drum 122C onto the intermediate transfer belt 143. The first transfer bias is a charge reverse to the charge of the surface of the photoreceptor drum 122C.

An image former 12C includes the photoreceptor drum 122C, the charger 123C, the irradiator 124C and the image developer 125C. The image forming apparatus 100 further includes image formers 12M, 12Y and 12K each having the same configuration as that of the image former 12C except for using a M-colored toner, a Y-colored toner and a K-colored toner, respectively.

A paper feeder 13 feeds a paper P between the second transfer roller 145 and the second transfer counter-roller 146. The paper feeder 13 includes a paper feed tray 131, a paper feed roller 132, a paper feed path 133 and a registration roller 134. The paper feed tray 131 contains papers P. The paper feed roller 132 feeds the paper P contained in the paper feed tray 131 to the paper feed path 133. The paper feed roller 132 takes out the paper P on the top of the contained papers P and puts it on the paper feed path 133 one by one.

In the paper feed path 133, a paper feed belt feeds the paper P taken out by the paper feed roller 132 between the second transfer roller 145 and the second transfer counter-roller 146 in the direction of an arrow (A) in FIG. 1. In the paper feed path 133, the registration roller 134 is located before the second transfer roller 145. When a part of the intermediate transfer belt 143 on which a toner image is formed reaches the second transfer roller 145, the registration roller 134 sends out a paper P.

A fixer 15 fixes a toner transferred onto a paper P from the intermediate transfer belt 143. A heat and a pressure are applied to a toner at the same time and a resin in the toner melts and adheres to the paper P. In the fixer 15, a fixing roller 151 and a fixing counter-roller 152 are located opposite to each other.

A paper P a toner is transferred on is put between the fixing roller 151 and the fixing counter-roller 152 and pressed. The fixing roller 151 includes a heater 153 inside. The heater 153 heats a paper P through the fixing roller 151. Near the fixer 15, a paper discharge opening 10 discharging a paper P out of the image forming apparatus 100 is located.

A display-operation unit 18 is located on the outside of the image forming apparatus 100. The display-operation unit 18 includes a display panel 181 and an operation unit 182. The display panel 181 is a panel displaying set point, selection menu, etc. such as touch panel receiving inputs from users. The operation unit 182 includes ten keys for users to enter various information on image formation, start key for users to enter start instruction, etc.

The image forming apparatus 100 further includes a controller 190 for controlling each of the above units.

Figure 3:
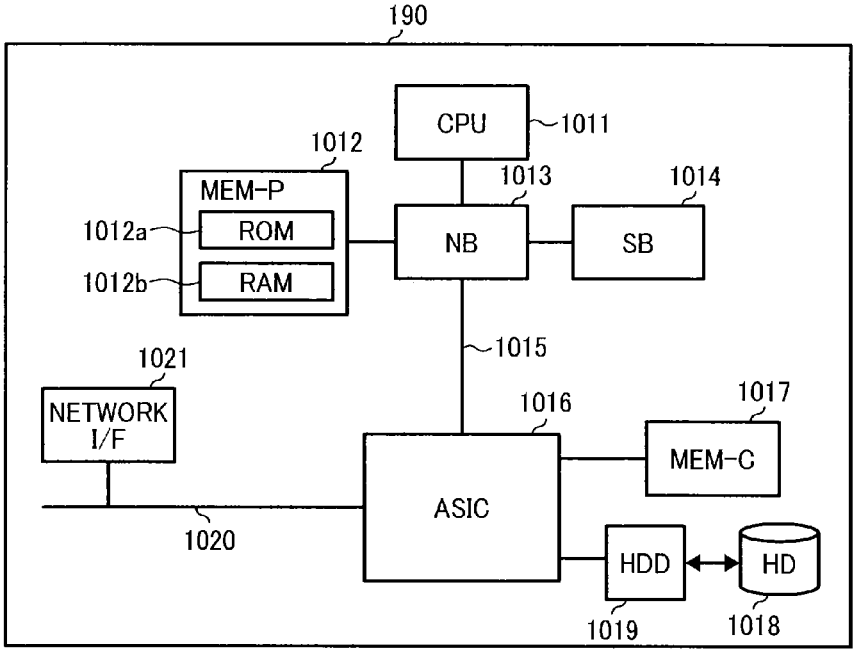
FIG. 3 is a block diagram showing an embodiment of controller hardware of the image forming apparatus of the present invention.

The controller 190 includes a CPU (Central Processing Unit) 1011, a main memory (MEM-P) 1012, a north bridge (NB) 1013 and a south bridge (SB) 1014 as shown in FIG. 3.

The controller 190 further includes an AGP (Accelerated Graphics Port) bus 1015, ASIC (Application Specific Integrated Circuit) 1016 and a local memory (MEM-C) 1017.

The controller 190 also includes a HD (Hard Disk) 1018, a HDD (Hard Disk Drive) 1019, a PCI bus 1020 and a network I/F 1021.

The CPU 1011 processes and calculates data, and controls operations of the above units according to programs memorized in the main memory 1012. The main memory 1012 is a storage area of the controller and includes a ROM (Read Only Memory) 1012*a* and RAM (Random Access Memory) 1012*b*. The ROM 1012*a* memorizes programs and data executing each function of the controller. The programs memorized in the ROM 1012*a* may be provided by a recording medium readable by computers such as CD-ROM, FD, CD-R and DVD in which installable or executable files are recorded.

The RAM 1012*b* is used for development of programs and data, and a memory for plotting in printing memory. The NB1013 is a bridge connecting the CPU1011, the MEM-P1012, the SB 1014 and the AGP bus 1015. The NB1014 is a bridge connecting NB1013 and peripheral devices. The AGP bus 1015 is a bus interface for graphics accelerator cards accelerating graphic processes. The ASIC 1016 includes a memory controller controlling the MEM-C1017 and plural DMACs (Direct Memory Access Controllers) rotating image data with hardware logic, etc. The ASIC 1016 is connected to the network I/F 1021 through the PCI bus 1020. The network I/F 1021 includes a USB (Universal Serial Bus) interface, an IEEE1394 (Institute of Electrical and Electronics Engineers 1394) interface, etc. MEM-C 1017 is a local memory used as an image buffer for copy and a code buffer. The HD 1018 is a storage for accumulating image data, font data used in printing and forms. The HDD 1019 controls reading out data from the HD 1018 and writing data therein according to control of the CPU 1011. The network I/F 1021 transmits information to outer devices such as information processors and receives information therefrom through a communication network.

Functional Configuration of Image Forming Apparatus 100

Figure 4:
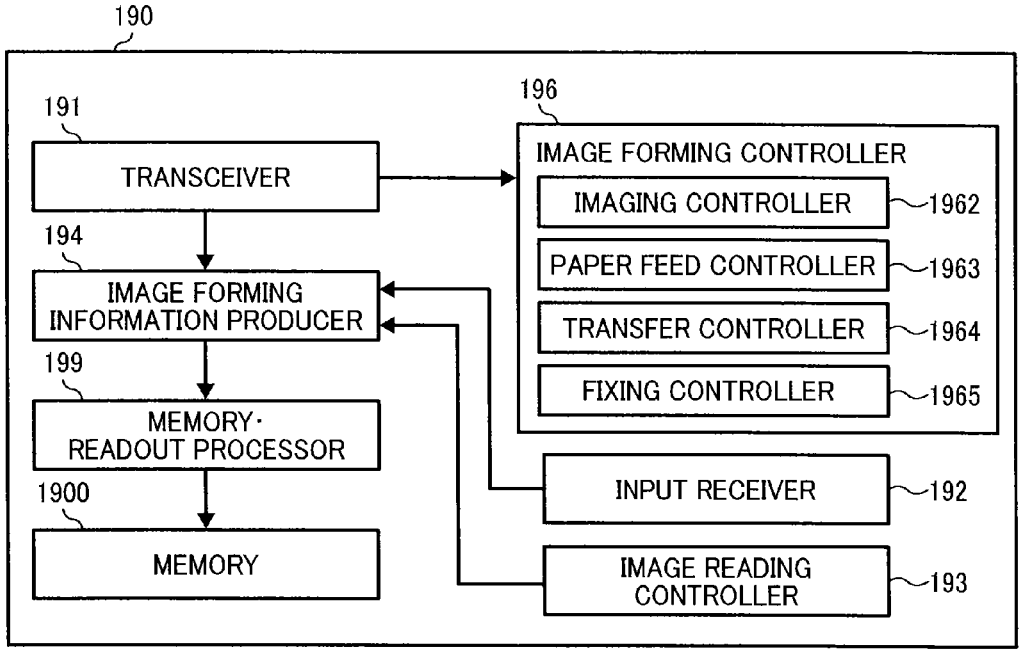
FIG. 4 is a block diagram showing an embodiment of functional composition of the image forming apparatus of the present invention.

The controller 190 in FIG. 3 includes a transceiver 191, an input receiver 192, an image reading controller 193, an image forming information producer 194, an image forming controller, a memory-readout processor 199 and a memory 1900 as shown in FIG. 4. These are functions or means activated or executed by orders from the CPU 1011 according to programs memorized in the ROM 1012*a* in FIG. 3.

The transceiver 191 in FIG. 4 is activated by the network I/F 1021 in FIG. 3 to receive RGB image information from image processors, etc. through a communication network. The RGB image information represents an image formed on the paper P using brightness of colors of red (R), green (G) and blue (B).

The input receiver 192 receives information entered by users through the display-operation unit 18.

The image reading controller 193 controls the scanner 11 in FIG. 2 to optically read an original image to produce RGB image information.

The memory 1900 consists of the ROM 1012*a* or the HD 1018 in FIG. 3. The image forming information producer 194 produces image forming information, based on RGB image information the transceiver 191 receives or the scanner 11 reads. Specifically, the image forming information producer 194 performs color apace transformation process on RGB image information and calculates toner amounts Vc, Vm, Vy and Vk of respective C, M, Y and K colors adhering to a paper P for each pixel.

The image forming information producer 194 may perform under color removal process, shading adjustment, misregistration adjustment, color space conversion, gamma correction, etc. besides the color apace transformation process. The image forming information represents toner adherence amounts Vc, Vm, Vy and Vk of respective C, M, Y and K color toners for each pixel to form an image on a paper.

An image forming controller 196 includes an imaging controller 1962 controlling the image formers 12C, 12M, 12Y and 12K and a paper feed controller 1963 controlling the paper feeder 13. The image forming controller 196 further includes a transfer controller 1964 controlling each of the first transfer rollers 144C, 144M, 144Y and 144K, the second transfer roller 145, the intermediate transfer belt 143, etc. and a fixing controller 1965 controlling the fixer 15.

Hardware Configuration of Gloss Applicator

Figure 5:
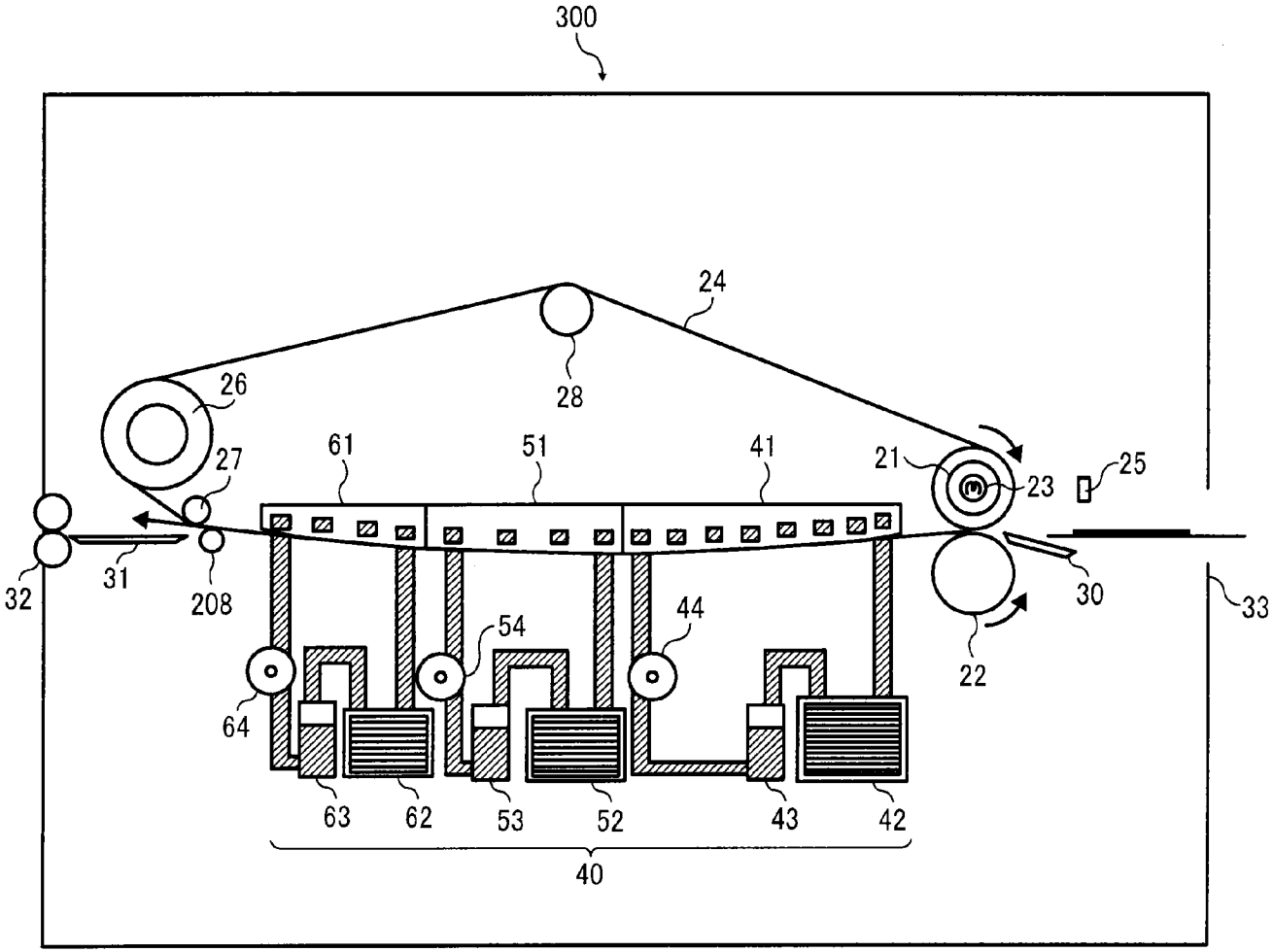
FIG. 5 is a schematic view illustrating an embodiment of the gloss applicator of the present invention.

A gloss applicator 300 in FIG. 5 smoothes the surface of a recording agent adhering to a paper P to generate gloss. The image forming apparatus 100 transfers a toner as the recording agent onto the paper P to form an image thereon.

The gloss applicator 300 includes a glosser belt 24, a gloss application heat roll 21 heating the glosser belt 24 and a cooler 40 cooling the glosser belt 24 heated by the gloss application heat roll 21.

The gloss applicator 300 further includes a drive roll 26 driving the glosser belt 24, a peeling roll 27 separating a paper P from the glosser belt 24 and a gloss application pressure roll 22 located opposite to the gloss application heat roll 21.

The gloss applicator 300 also include a tension roll 28 keeping a tension of the glosser belt 24, a guide member 30 delivering a paper P thereto and a guide member 31 a paper P peeled therefrom.

The gloss applicator 300 further includes an insert opening 33 near the paper discharge opening 10 of the image forming apparatus 100 and a paper discharge opening 32 discharging a paper P, located opposite to the insert opening 33 on its chassis. The gloss applicator 300 also includes a curvature control roller 208 assisting a paper P to peel from the glosser belt 24 near the peeling roll 27, a controller 220 controlling an activation and a function of each member in FIG. 6 and a temperature sensor 25 detecting a temperature of the surface of the glosser belt 24.

As shown in FIG. 5, the glosser belt 24 is hung over the gloss application heat roll 21, the drive roll 26, the peeling roll 27 and the tension roll 28, and flat from the vicinity of the insert opening 33 to that of the paper discharge opening 32 of the gloss applicator 300. Hereinafter, a circulating path formed by the glosser belt 24 is referred to as a closed surface.

Figure 7:
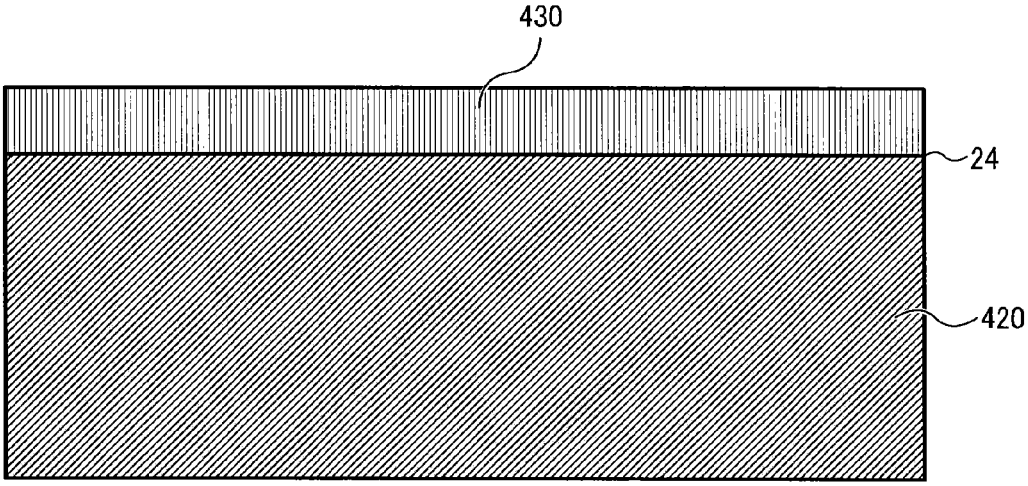
FIG. 7 is a cross-sectional view illustrating an embodiment of layer composition of the belt of the present invention.

The glosser belt 24 is a double-layered belt including a substrate 420 and a surface layer 430 formed thereon as shown in FIG. 7.

The substrate 420 is formed of polyimide having a thickness of 80 μm and high heat resistance.

Besides the polyimide, polyester, polyethylene, polyethyleneterephthalate, polyethersulfone, polyether ketone, polysulfone, polyamideimide, polyamide, etc. can be used as the substrate 420. The substrate 420 may have a thickness of from 1 to 300 μm.

The surface layer 430 is formed of non-elastomer silicone resin having a thickness of 2 μm. The elastomer is typically a rubber-shaped elastic industrial material, and the non-elastomer is an industrial material which is not used as an elastic material, having no rubber-shaped elasticity or small elasticity, i.e., an industrial material used as a non-elastic material.

The surface layer 430 formed of a non-elastomer resin prevents an unsymmetrical pressure due to elastic deformation of the glosser belt 24 when a paper P is heated and pressed by the gloss application heat roll 21 and the gloss application pressure roll 22. Namely, a pressure from the gloss application pressure roll 22 and the gloss application heat roll 21 is applied to a paper P without waste to assure smoothness when surface status is transferred. A non-elastomer silicone resin used as the surface layer 430 is formed by coating a material mainly having a polysiloxane network on the substrate 420, and heating and firing.

The surface layer 430 is formed by the above coating. Therefore, the resin surface has high smoothness, stably feeds a paper P, having high adhesiveness therewith when heated, and separates the paper P, having high releasability therewith after cooled.

The surface of the surface layer contacting a paper P is smooth, and preferably has an arithmetic average roughness Ra not greater than 0.3 μm, and more preferably not greater than 0.1 μm.

Further, the surface layer 430 has a thickness not greater than 5 μm. Therefore, a pressure is applied to a paper P without any more waste to more assure smoothness when surface status is transferred. In addition, the total heat capacity of the glosser belt 24 is controlled, and the belt is efficiently heated and cooled.

The gloss application heat roll 21 and the gloss application pressure roll 22 are located opposite to each other across the glosser belt 24 near the guide member 30 to form a gloss application nip.

The gloss application nip has a width of from 10 to 40 mm.

The gloss application heat roll 21 includes a cylindrical aluminum roll having a diameter of from 50 to 120 mm, a silicone rubber layer formed on the outer circumference thereof and a halogen heater 23 inside. The surface of the silicone rubber layer may be covered by a fluorine resin tube having a thickness of from 30 to 200 μm.

The gloss application pressure roll 22 includes a cylindrical metal roll, a silicone rubber layer formed on the outer circumference thereof, having a thickness of from 5 to 30 mm and a fluorine resin tube formed on the silicone rubber layer, having a thickness of from 30 to 200 μm.

The temperature sensor 25 is located near the gloss application heat roll 21 and serves as a temperature detector detecting a temperature of the surface of the glosser belt 24. The temperature sensor 25 and the controller 220 controls on and off of the halogen heater 23. The temperature sensor 25 uses a non-contact thermopile in this embodiment, but may use a contact thermistor. The temperature of the surface of the glosser belt 24 on the gloss application heat roll 21 is controlled to be higher than a melting point of a toner, e.g., 100 to 180° C. The gloss application heat roll 21 not only heats a paper P but also presses the paper P with the gloss application pressure roll 22 so that the surface of a toner on the paper P and the smooth surface of the glosser belt 24 contact each other. Thus, a toner adhering to the paper P melts. The gloss application heat roll 21 is not necessarily formed of aluminium. Metals having high heat conductivity are preferably used in terms of heat efficiency.

Figure 6:
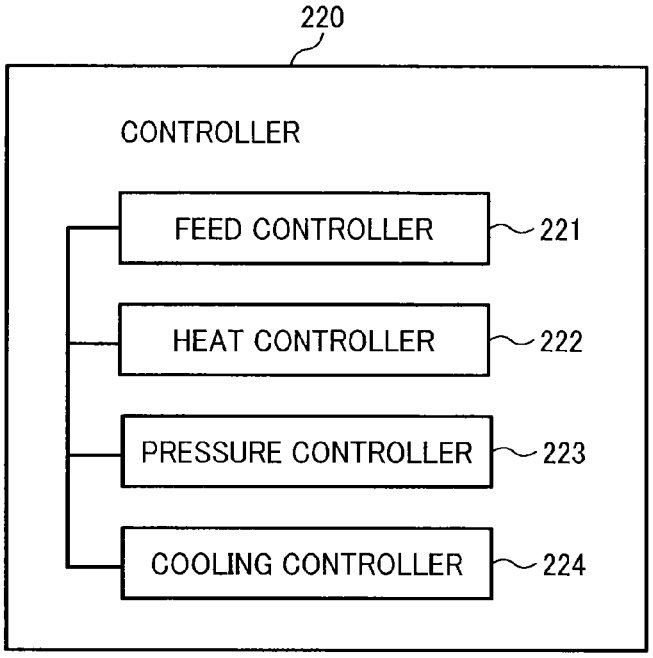
FIG. 6 is a block diagram showing an embodiment of functional composition of the gloss applicator of the present invention.

The controller 220 includes a CPU 211 controlling total operations of the gloss applicator 300, a ROM 212 memorizing programs and data executing each function of the controller 220 and a RAM 213 used as a work area of the CPU 211 as shown in FIG. 6. In addition, the controller 220 includes a HD (Hard Disk) 214 memorizing various data and a HDD (Hard Disk Drive) 215 reading out various data from the HD 214 or writing them therein according to control of the CPU 211. Further, the controller 220 includes a network I/F (Interface) transmitting data through a communication network and a bus line 217 such as address bus and data bus electrically connecting the above components. A gloss generating process control program controlling the gloss applicator 300 is memorized in the ROM 212.

The cooler 40 is located downstream from a contact point between the glosser belt 24 and the gloss application heat roll 21 to cool a paper P after heated by the gloss application heat roll 21. The cooler 40 uses a liquid cooling method in this embodiment. A paper P heated by the gloss application heat roll 21 is cooled to have a temperature not higher than a melting point of a toner, e.g., 40° C. or lower. The cooler 40 cools a paper P to harden a toner adhering thereto.

The cooler 40 includes a cooling member 41 passing a coolant inside to cool the glosser belt 24, a radiator 42, a tank 43 and a pump 44. These members are connected through tubes and the coolant circulates therein.

The cooling member 41 is formed of a heat conductive metal such as aluminum and includes an aperture for the coolant to circulate so as to reciprocate in the cooling member 41.

In this embodiment, the cooler 40 is located in series. The cooling member 41 has a long length at the gloss application heat roll 21 side in the feed direction of the glosser belt 24. The side of the gloss application heat roll 21 has a larger contact area than the side of the peeling roll 27. This efficiently cools the glosser belt 24.

The cooling member 41 contacts the glosser belt 24 and cools the belt to cool a toner image on a paper P coherently fed by the belt.

The radiator 42 has a fan to cool the coolant and changes an air volume of the fan to control cooling quantity. The air volume of the fan is preferably from 0 to 11 $m^3$/min to effectively cool a toner on a paper P.

The pump 44 controls a flow rate of the coolant flown in the cooler and preferably controls the flow rate to be 0 to 15 L/min.

The cooler 40 cools and hardens a toner adhering to a paper P coherent to the glosser belt 24 to transfer the surface status thereof to the toner, and the paper P is peeled by the peeling roll 27.

Since the surface layer 430 of the glosser belt 24 feeding a paper P is not an elastomer and has negligible elastic deformation, releasability between the glosser belt 24 and a toner is high. Therefore, a pressure is applied to the surface of a paper P without waste. Transferability of the surface status is high and an image having high glossiness.

Similarly to the cooling member 41, the radiator 42, the tank 43 and the pump 44, the cooling members 51 and 61, the radiators 52 and 62, the tanks 53 and 63 and the pumps 54 and 64 can plurally be combined in series.

In this embodiment, three are combined and contacted to the glosser belt 24 to be more efficiently cooled.

FIG. 5 illustrates three coolers 40 in series, but not necessarily be three for the purpose of sufficiently cooling.

The peeling roll 27 is located near the paper discharge opening 32 and cooled by the cooler 40 to peel a paper P from the glosser belt 24 by curvature after a toner is hardened.

The drive roll 26 is located near the insert opening 33 so as to hang the glosser belt 24 over the roll and rotated by ab unillustrated drive source such that a part of the glosser belt 24 horizontally held travels from the insert opening 33 to the paper discharge opening 32. Further, a discharged paper tray receiving a discharged paper P is located on the outside of the paper discharge opening 32.

A curvature control roller 208 is located near the peeling roll 27 with an axis perpendicular to the travel direction of the glosser belt 24. The curvature control roller 208 is located so as to press the glosser belt 24 to the inside of a closed surface formed thereby.

When a paper P fed by the glosser belt 24 travels along the peeling roll 27, the glosser belt 24 has a curvature larger than that when the curvature control roller 208 is not located. The curvature control roller 208 may contact the peeling roll 27 or separate therefrom. At a contact point with the glosser belt 24, the curvature control roller 208 rotates such that the surface thereof travels in the same direction of the glosser belt 24.

Functional Composition of Gloss Applicator

Figure 8:
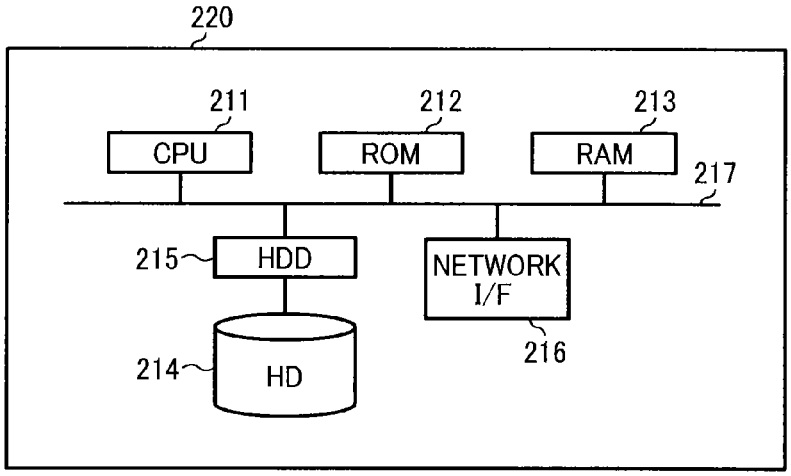
FIG. 8 is a block diagram showing an embodiment of controller hardware of the gloss applicator of the present invention.

The controller 220 includes a feed controller 221, a heat controller 222, a pressure controller 223 and a cooling controller 224 as shown in FIG. 6. These are functions or means executed when activated by an order from CPU 211 according to a program memorized in ROM 212 shown in FIG. 8.

The feed controller 221 controls the drive roll 26 to rotate the glosser belt 24. The heat controller 222 controls the halogen heater 23 of the gloss application heat roll 21 to generate heat. The pressure controller 223 controls the gloss application pressure roll 22 and the gloss application heat roll 21 to press a paper P. The cooling controller 224 controls the cooler 40 to cool a paper P.

Process/Operation of Embodiment

First, the transceiver 191 receives RGB image information from an outer information processor. When the transceiver 191 receives RGB image information, the image forming information producer 194 produces image forming information based on the RGB image information.

Specifically, the image forming information producer 194 performs a color space conversion process on the RGB image information to calculate toner adherence amounts Vc, Vm, Vy and Vk. Besides the color space conversion process, the image forming information producer 194 may execute known image processes such as an under color removal process, a color correction process and a space frequency correction process. Further, the image forming information producer 194 calculates the toner adherence amounts Vc, Vm, Vy and Vk on all pixels on a paper and produces image forming information representing positions and the toner adherence amounts thereon.

When image forming information is produced, the paper feed controller 1963 controls the paper feeder 13 to feed papers. Specifically, the paper feed roller 132 of the paper feeder 13 takes out papers P contained in the paper feed tray 131 one by one, and feeds the paper on the paper feed path 133. The paper feed path 133 feeds a paper to the registration roller 134. When a paper P reaches the registration roller 134, the registration roller 134 clamps the paper P to wait until a toner image formed on the intermediate transfer belt 143 reaches the second transfer roller 145. When the toner image formed on the intermediate transfer belt 143 reaches the second transfer roller 145, the registration roller 134 feeds the paper P between the second transfer roller 145 and the second transfer counter-roller 146.

The imaging controller 1962 controls each of the image formers 12C, 12M, 12Y and 12K to transfer a toner onto each of the photoreceptor drums 122C, 122M, 122Y and 122K. Specifically, the charger 123C uniformly charges the surface of the photoreceptor drum 122C. The irradiator 124C irradiates the surface of the photoreceptor drum 122C with a laser beam, based on the toner adherence amount Vc of the image forming information produced by the image forming information producer 194. Thus, an electrostatic latent image for transferring a C-color toner in an amount of Vc onto a paper is formed on the surface of the photoreceptor drum 122C.

When an electrostatic latent image is formed on the surface of the photoreceptor drum 122C, the image developer 125C develops the electrostatic latent image with a C-color toner. Then, a C-color toner image is formed on the surface of the photoreceptor drum 122C. Similarly, on the surfaces of the photoreceptor drums 122M, 122Y and 122K, M-color, Y-color and K-color toner images are formed, respectively. Explanations of processes of forming these color toner images are omitted because of being the same as that of forming the C-color toner image on the surface of the photoreceptor drum 122C.

When a toner image is formed on the surface of each of the photoreceptor drums 122C, 122M, 122Y and 122K with each of the toners, the transfer controller performs transfer processes. Specifically, each of the first transfer rollers 144C, 144M, 144Y and 144K applies a first transfer bias to the intermediate transfer belt 143. Then, a toner image on the surface of each of the photoreceptor drums 122C, 122M, 122Y and 122K is (first) transferred onto the intermediate transfer belt 143.

The intermediate transfer belt 143 travels in an arrow direction (B) by rotations of the drive roller 141 and the driven roller 142. When a part of the intermediate transfer belt 143 on which a toner image is transferred on reaches the second transfer roller 145, the registration roller 134 feeds a paper P. When a paper P fed by the registration roller 134 reaches the second transfer roller 145, the second transfer roller 145 clamps the paper P and the intermediate transfer belt 143 with the second transfer counter-roller 146 and applies a second transfer bias to the paper P. This (second) transfers a toner image formed in the surface of the intermediate transfer belt 143 onto the paper P.

When a toner image is transferred onto a paper P, the fixing controller 1965 controls the fixer 15 to perform a fixing process. Specifically, a paper P reaches a contact point between the fixing roller 151 and the fixing counter-roller 152, the fixing roller 151 clamps the paper P with the fixing counter-roller 152. Then, since the fixing roller is heated by the heater 153, the paper P is heated at a predetermined temperature while pressed. A toner forming a toner image transferred on the paper P melts, and the fixing roller 151 presses the paper P the melted toner adheres on to fix the toner thereon.

When the fixer 15 fixes a toner on a paper P, the paper P is discharged out of the image forming apparatus 100 from the paper discharge opening 10. The paper P discharged from the paper discharge opening 10 of the image forming apparatus 100 enters the gloss applicator 300.

The gloss applicator 300 performs a process of generating gloss on an image formed on the paper P. Details of the process is explained, referring to FIG. 5. The gloss applicator 300 receives the paper P discharged from the paper discharge opening 10 of the image forming apparatus 100 from the insert opening 33 such that the surface of the paper P on which a toner adhering to contacts the smooth surface of the glosser belt 24.

Then, the feed controller 221 controls the glosser belt 24 to feed a paper P from the insert opening 33 to the paper discharge opening 32 of the gloss applicator 300 at a speed of from 50 to 700 mm/s by a drive force of the drive roll 26.

When the end of a paper P reaches a nip formed by the gloss application pressure roll 22 and the gloss application heat roll 21, the pressure controller 223 controls them to clamp and press the paper P. Then, the heat controller 222 controls the halogen heater 23 to generate heat to keep a temperature of the surface of the glosser belt 24 at a position the temperature sensor 25 measures at 150° C. The paper P is heated at from 100 to 120° C. when passing the gloss application nip, and a toner on the surface of the paper P softens and melts.

When the softened and melted toner forming an image on the paper P contacts the surface layer 430 of the glosser belt 24, the toner surface becomes smooth. The heating and pressing transfer the smoothness of the surface layer 430 to the toner surface.

After a paper P is heated and pressed by the gloss application pressure roll 22 and the gloss application heat roll 21, the cooling controller 224 controls the cooler 40 to cool the paper P to have a temperature not higher than 40° C. The toner fixed on the surface of the paper P is hardened while the surface status of the smooth surface of the glosser belt 24 is transferred on the toner, and stably held having a smooth surface.

Figure 9:
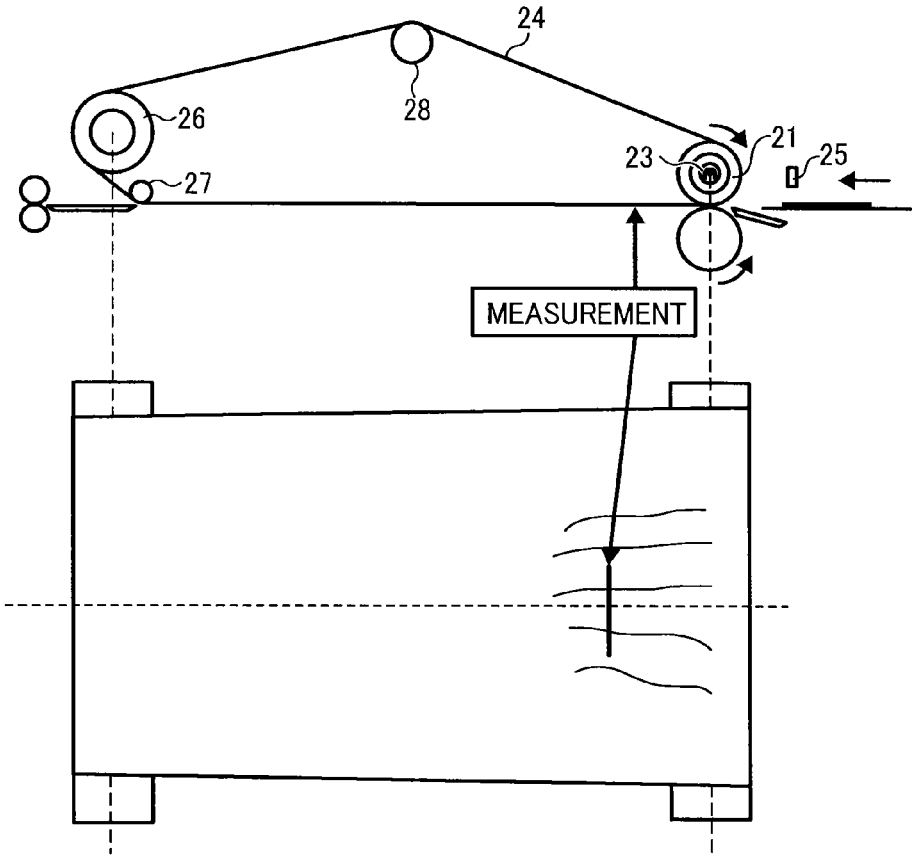
FIG. 9 is a schematic view illustrating an example of wave image and measurement site of the belt of the present invention.
Figure 10:
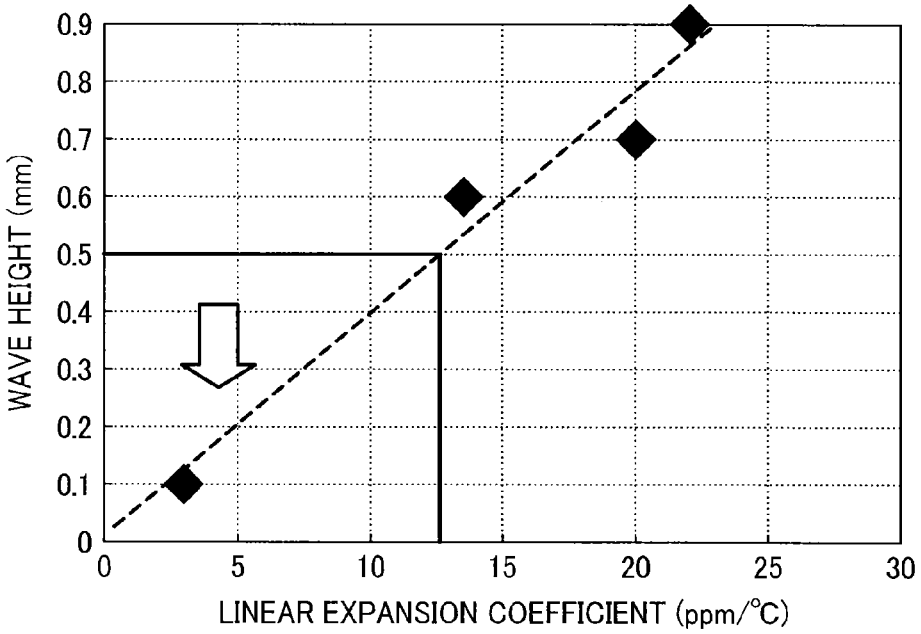
FIG. 10 is a diagram showing an example of relationship between the linear expansion coefficient and the wave height in an embodiment of the present invention.

Then, the glosser belt 24 has a difference of surface temperature not less than 100° C. between the heater and the cooler. The glosser belt 24 has a thermal expansion according to a specific linear expansion coefficient and has a deviation between the heater and the cooler in a width direction. When a conventionally-used resin film Upilex®-S having a linear expansion coefficient of 20 ppm/° C. from UBE INDUSTRIES, LTD. is used as the glosser belt 24, there is a thermal expansion not less than 0.6 mm relative to A4 longitudinal size 297 mm at 23° C. The deviation between the heater and the cooler in the width direction causes a minute waves of the glosser belt 24 as shown in FIGS. 9 and 10. Herein after, a difference between an upper end and a lower end of the waves due to thermal expansion between the heater and the cooler is referred to as a wave height. The wave height is measured as a difference of elevation in a cross-section of the glosser belt 24 at a part thereof indicated by a bold line near the gloss application heat roll 21 in FIG. 9.

A soft paper follows the waving glosser belt 24, but a firm paper does not. Namely, according to the wave height and the paper P, the paper P may not follow the glosser belt 24, resulting in jamming or insufficient glossiness of images.

Particularly, firm thick papers cause large damages to the glosser belt 24, resulting in abnormal images such as offset or short life of the belt.

Typically, since an endless belt used in an image forming apparatus is controlled to have a constant temperature on its circumference when rotating while heated, there is a small difference of temperature. Alternatively, when an elastic material such as a silicone rubber is used as a surface layer, the elastic deformation reduces the wave height.

FIG. 10 shows a relation between the wave height and the linear expansion coefficient of the glosser belt in this embodiment. The glosser belt 24 having a wave height of 0.5 mm or lower contacts a paper close and stably feeds the paper while keeping high glossiness thereof.

The substrate which is a polyimide resin having a linear expansion coefficient of 12 ppm/° C. or less prevents the glosser belt from waving to stable feed a paper. Specific examples of the substrate 420 include XENOMAX® from TOYOBO CO., LTD., and POMIRAN® T from Arakawa Chemical Industries, Ltd.

Such a glosser belt has a wave height of 0.5 mm or lower, contacts a paper close and stably feeds the paper while keeping high glossiness thereof. This reduces damages to the glosser belt 24 and prevents production of defective images such as offset while decreasing frequency of exchanging the glosser belt 24.

The glosser belt 24 apparently changes in the wave height according to a distance from the heater to cooler. In this embodiment, the glosser belt 24 has a distance from the heater to cooler so as to have a wave height of 0.5 mm or lower, contacts a paper close and stably feeds the paper while keeping high glossiness thereof. This reduces damages to the glosser belt 24 and prevents production of defective images such as offset while decreasing frequency of exchanging the glosser belt 24.

Finally, a paper P is separated from the glosser belt 24 at a position of the peeling roll 27.

Then, the glosser belt 24 has a curvature larger than that when the curvature control roller 208 is not located, and a paper P is easier to separate from the glosser belt 24.

The curvature control roller 208 stably peel a paper P from the glosser belt 24 without damaging the surface of a paper P on which an image is formed even when both of them are thin.

A paper P separated from the glosser belt 24 is loaded on the guide member 31. The guide member 31 travels to the paper discharge opening 32 to feed the paper P. The paper P is discharged out of the gloss applicator 300 when reaching the paper discharge opening 32. The discharged paper P is contained in the discharged paper tray.

An image obtained on the paper P has a glossiness of from 65 to 80 at an angle of 20°.

Having now fully described the invention, it will be apparent to one of ordinary skill in the art that many changes and modifications can be made thereto without departing from the spirit and scope of the invention as set forth therein.

For examples, as shown in FIG. 1, the image forming apparatus 100 and the gloss applicator 300 may be located close to each other. Alternatively, they may be located away from each other with a feed belt feeding a paper P between the paper discharge opening 10 of the image forming apparatus 100 and the insert opening 33 of the gloss applicator 300.

The image forming apparatus 100 and the gloss applicator 300 are separate, but a sole unit may include functions of the both.

The transceiver 191 receives image information, but the reading sensor 112 controlled by the image reading controller 193 may read out RGB image information from an original placed on the contact glass 111.

The image forming apparatus 100 forms an image using a C-color toner, a M-color toner, a Y-color toner and a K-color toner, but may use special toners such as a clear toner a white toner besides the C-color toner, the M-color toner, the Y-color toner and the K-color toner.

Further, the image forming apparatus 100 may use an ink instead of a toner as a recording agent to form an image as long as the image improves in glossiness when melted.

The image forming apparatus 100 forms an image, based on RGB image information, but may form an image, based on monochrome image information.

Figure 11:
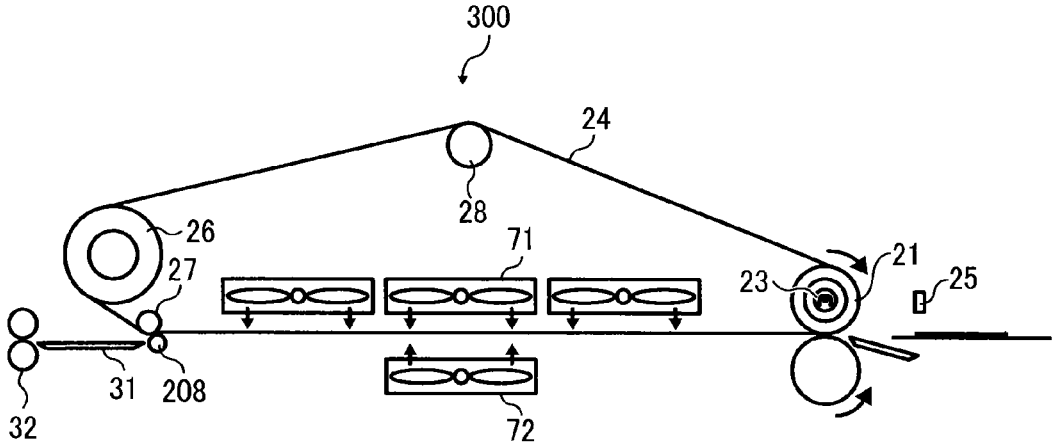
FIG. 11 is a schematic view illustrating a modified embodiment of the cooler the present invention.

The cooler 40 is a water-cooling type using a coolant and a radiator, but may be an air cooling type using cooling fans 71 and 72 feeding air from the top and the bottom to cool the glosser belt 24 as shown in FIG. 11.

In this case, a duct is properly added to uniform the flow rate, which reduces a difference of temperature and prevents the glosser belt 24 form waving.

The disclosure of this patent specification is not intended to be limited to the specific terminology so selected, and it is to be understood that each specific element includes all technical equivalents that operate in a similar manner and achieve a similar result.

What is claimed is:

1. A gloss applicator, comprising:

a belt configured to feed a recording material, comprising a substrate and a surface layer contacting a surface of the recording material an image is formed on;

a heater configured to heat the belt; and a cooler configured to cool the belt, wherein the surface layer is not an elastomer, the recording material is fed while the belt contacts the surface thereof, the belt heated by the heater heats the recording material, the belt cooled by the cooler cools the recording material, and the recording material is released from the belt, and wherein the surface layer has a thickness not greater than 5 μm.

2. The gloss applicator of claim 1, wherein the surface layer is coated on the surface of the substrate.

3. The gloss applicator of claim 1, wherein the substrate is formed of a polyimide resin.

4. The gloss applicator of claim 1, wherein the heater and the cooler has a distance therebetween such that the belt has a wave height due to a difference of temperature therebetween not higher than 0.5 mm.

5. An image forming apparatus, comprising the gloss applicator according to claim 1.

6. A gloss applicator, comprising:

a belt configured to feed a recording material, comprising a substrate and a surface layer contacting a surface of the recording material an image is formed on;

a heater configured to heat the belt; and a cooler configured to cool the belt, wherein the surface layer is not an elastomer, the recording material is fed while the belt contacts the surface thereof, the belt heated by the heater heats the recording material, the belt cooled by the cooler cools the recording material, and the recording material is released from the belt, and wherein the heater and the cooler has a distance therebetween such that the belt has a wave height due to a difference of temperature therebetween not higher than 0.5 mm.

7. The gloss applicator of claim 6, wherein the surface layer is coated on the surface of the substrate.

8. The gloss applicator of claim 6, wherein the substrate is formed of a polyimide resin.

9. An image forming apparatus, comprising the gloss applicator according to claim 6.

* * * * *